US008845265B2

(12) United States Patent
Oyama et al.

(10) Patent No.: US 8,845,265 B2
(45) Date of Patent: Sep. 30, 2014

(54) FRONT LOADER

(75) Inventors: Kosuke Oyama, Sakai (JP); Masahiro Sugioka, Itami (JP); Shusaku Yamaguchi, Sakai (JP)

(73) Assignee: Kubota Corporation, Osaka (JP)

( * ) Notice: Subject to any disclaimer, the term of this patent is extended or adjusted under 35 U.S.C. 154(b) by 394 days.

(21) Appl. No.: 13/419,829

(22) Filed: Mar. 14, 2012

(65) Prior Publication Data

US 2012/0251285 A1 Oct. 4, 2012

(30) Foreign Application Priority Data

Mar. 30, 2011 (JP) ..... 2011-75251

(51) Int. Cl.

| | |
|---|---|
| ***E02F 3/43*** | (2006.01) |
| ***E02F 9/22*** | (2006.01) |
| ***E02F 3/34*** | (2006.01) |
| ***E02F 3/627*** | (2006.01) |
| ***E02F 9/08*** | (2006.01) |

(52) U.S. Cl.

CPC ..... *E02F 3/432* (2013.01); *E02F 9/2267* (2013.01); *E02F 3/3417* (2013.01); *E02F 3/627* (2013.01); *E02F 9/0875* (2013.01)

USPC ..... 414/708; 414/700; 414/706

(58) Field of Classification Search

CPC ..... A01C 3/04; B66F 9/065; E02F 3/3405; E02F 3/3408; E02F 3/3411; E02F 3/43; E02F 3/431; E02F 3/432; E02F 3/433; E02F 3/436

USPC ..... 414/699, 700, 701, 706, 707, 708

See application file for complete search history.

(56) References Cited

U.S. PATENT DOCUMENTS

| | | | |
|---|---|---|---|
| 4,825,568 | A | 5/1989 | Kawamura et al. |
| 4,966,518 | A | 10/1990 | Kourogi et al. |

FOREIGN PATENT DOCUMENTS

| | | |
|---|---|---|
| JP | 01-163325 | 6/1989 |
| JP | 2009-52287 | 3/2009 |
| JP | 2011-017204 | 1/2011 |

OTHER PUBLICATIONS

U.S. Appl. No. 13/419,844 to Ryoichi Nishi, filed Mar. 14, 2012.

Office Action in Japanese Application 2011-075251, mail date is Jul. 30, 2013.

*Primary Examiner* — Saul Rodriguez

*Assistant Examiner* — Brendan Tighe

(74) *Attorney, Agent, or Firm* — Greenblum & Bernstein, P.L.C.

(57) ABSTRACT

A detection link of a spill guard link mechanism is pivoted and connected to a bucket bracket in a position proximate to a bucket pivot support axis rotatably supporting a bucket and above a lower surface of a boom.

4 Claims, 17 Drawing Sheets

FRONT LOADER

CROSS-REFERENCE TO RELATED APPLICATIONS

The present application claims priority under 35 U.S.C. §119 of Japanese Application No. 2011-75251, filed on Mar. 30, 2011, which is herein expressly incorporated by reference in its entirety.

BACKGROUND OF THE INVENTION

1. Field of the Invention

The present invention relates to a front loader.

2. Description of Related Art

A front loader disclosed in Related Art 1 is a conventional front loader that prevents soil from spilling out of a bucket during lifting of a boom. The front loader has a boom support fixed to a front portion of a tractor, a boom swingable upward and downward and supported by the boom support in a rear end portion thereof so as to be rotatable around a left-right axis, a bucket bracket pivoted in a front end portion of the boom through a bucket pivot support axis, and a bucket fixed to the bucket bracket so as to be rotatable around the bucket pivot support axis.

The boom is lifted and lowered in association with expansion and contraction of a boom cylinder provided across a middle portion of the boom and the boom support. The bucket performs scooping and dumping in association with expansion and contraction of a bucket cylinder. A bottom end portion of the bucket cylinder is pivoted and connected to the middle portion of the boom. A front end portion of a piston rod of the bucket cylinder is pivoted and connected to first end portions of a pair of bucket links. A second end portion of the first bucket link is pivoted and connected to an upper portion of the bucket pivot support axis of the bucket bracket. A second end portion of the second bucket link is pivoted and connected to a pivot support bracket fixed to the lower surface of the boom and projecting downward therefrom.

The front loader performs dumping of the bucket by projecting the piston rod of the bucket cylinder and performs scooping of the bucket by retracting the piston rod of the bucket cylinder. Furthermore, the front loader has a control valve and a spill guard link mechanism, the control valve allowing the bucket to perform dumping during lifting of the boom, the spill guard link mechanism maintaining the posture of the bucket by controlling the control valve such that the bucket performs dumping in conjunction with lifting of the boom.

Specifically, in the front loader, the boom is lifted in a lifted state where the bucket filled with soil is lifted, and then the spill guard link mechanism controls the control valve from a neutral position to a control position to allow the bucket to perform dumping and maintain the lifted state. Thus, the soil in the bucket can be prevented from spilling.

The spill guard link mechanism has a detection link detecting the dumping of the bucket so as to provide feedback to the control valve of the dumping of the bucket during lifting of the boom having the bucket such that the control valve is controlled in a direction returning to the neutral position. The detection link is disposed at the front end portion of the boom. A first end portion of the detection link is pivoted and connected to a connecting portion provided in the second end portion of the second bucket link to detect the dumping of the bucket based on the movement of the second bucket link.

A second end portion of the detection link is pivoted and connected to a front end portion of a rotation arm provided in the front portion of the boom and rotatable around the left-right axis. The front end portion of the rotation arm is interlocked and connected with a spool of the control valve through a link mechanism. The control valve is provided on the boom support.

[Related Art 1] Japanese Patent Laid-Open Publication No. 2009-52287

In the conventional front loader, the first end portion of the detection link of the spill guard link mechanism is pivoted and connected to the connecting portion in the second end portion of the second bucket link, and the second end portion of the second bucket link is pivoted and connected to the pivot support bracket fixed to the lower surface of the boom and projecting downward therefrom. Thus, there is a circumstance where the first end portion of the detection link may come into contact with the ground. An advantage of the present invention is to provide a front loader that overcomes such a circumstance.

SUMMARY OF THE INVENTION

In view of the technical circumstance, an advantage of the present invention is to provide a front loader including a boom lifted and lowered by a boom cylinder; a bucket bracket pivoted and supported at a front end portion of the boom through a bucket pivot support axis; a bucket fixed by the bucket bracket and performing scooping and dumping in association with the bucket bracket rotated around the bucket pivot support axis by a bucket cylinder; a control valve allowing the bucket to perform dumping during lifting of the boom; and a spill guard link mechanism controlling the control valve to allow the bucket to perform dumping in conjunction with lifting of the boom so as to maintain a posture of the bucket, the spill guard link mechanism including a detection link disposed at the front end portion of the boom to detect dumping of the bucket during lifting of the boom. The detection link is pivoted and connected to the bucket bracket in a position proximate to the bucket pivot support axis and above the lower surface of the boom.

An aspect of the present invention provides the front loader, further including a rotation arm and an interlock arm, the rotation arm being rotatably supported around a rotation support axis in the front portion of the boom and being interlocked and connected to the control valve through an interlock mechanism, the interlock arm being rotated integrally with the rotation arm. The rear end portion of the detection link is pivoted and connected to the interlock arm, such that a pivot support portion of the rear end portion of the detection link is positioned above the lower surface of the boom and a pivot support portion of the front end portion of the detection link is positioned above the axis center of the bucket pivot axis.

Another aspect of the present invention provides the front loader, in which a pair of left and right booms is provided and the detection link is disposed on the interior in the left-right direction of one of the booms.

The present invention has the effects below. The detection link of the spill guard link mechanism is pivoted and connected to the bucket bracket in a position proximate to the bucket pivot support axis and above the lower surface of the boom, and thus the detection link is prevented from coming into contact with the ground. Furthermore, the pivot support portion of the front end portion of the detection link is positioned above the axis center of the bucket pivot axis, and thus the detection link is more surely prevented from coming into contact with the ground.

The detection link is disposed on the interior in the left-right direction of the boom, and thus the side of the detection link is guarded by the boom.

BRIEF DESCRIPTION OF THE DRAWINGS

The present invention is further described in the detailed description which follows, with reference to the noted plurality of drawings by way of non-limiting examples of exemplary embodiments of the present invention, in which like reference numerals represent similar parts throughout the several views of the drawings, and wherein.

DETAILED DESCRIPTION OF PREFERRED EMBODIMENTS

The particulars shown herein are by way of example and for purposes of illustrative discussion of the mmbodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

An embodiment of the present invention is explained below with reference to the drawings. FIGS. 1 to 10 illustrate a first embodiment, while FIGS. 11 to 17B illustrate a second embodiment. The first embodiment is an example in which the present invention is applied to a front loader having no bucket link, while the second embodiment is an example in which the present invention is applied to a front loader having a bucket link.

Figure 1:
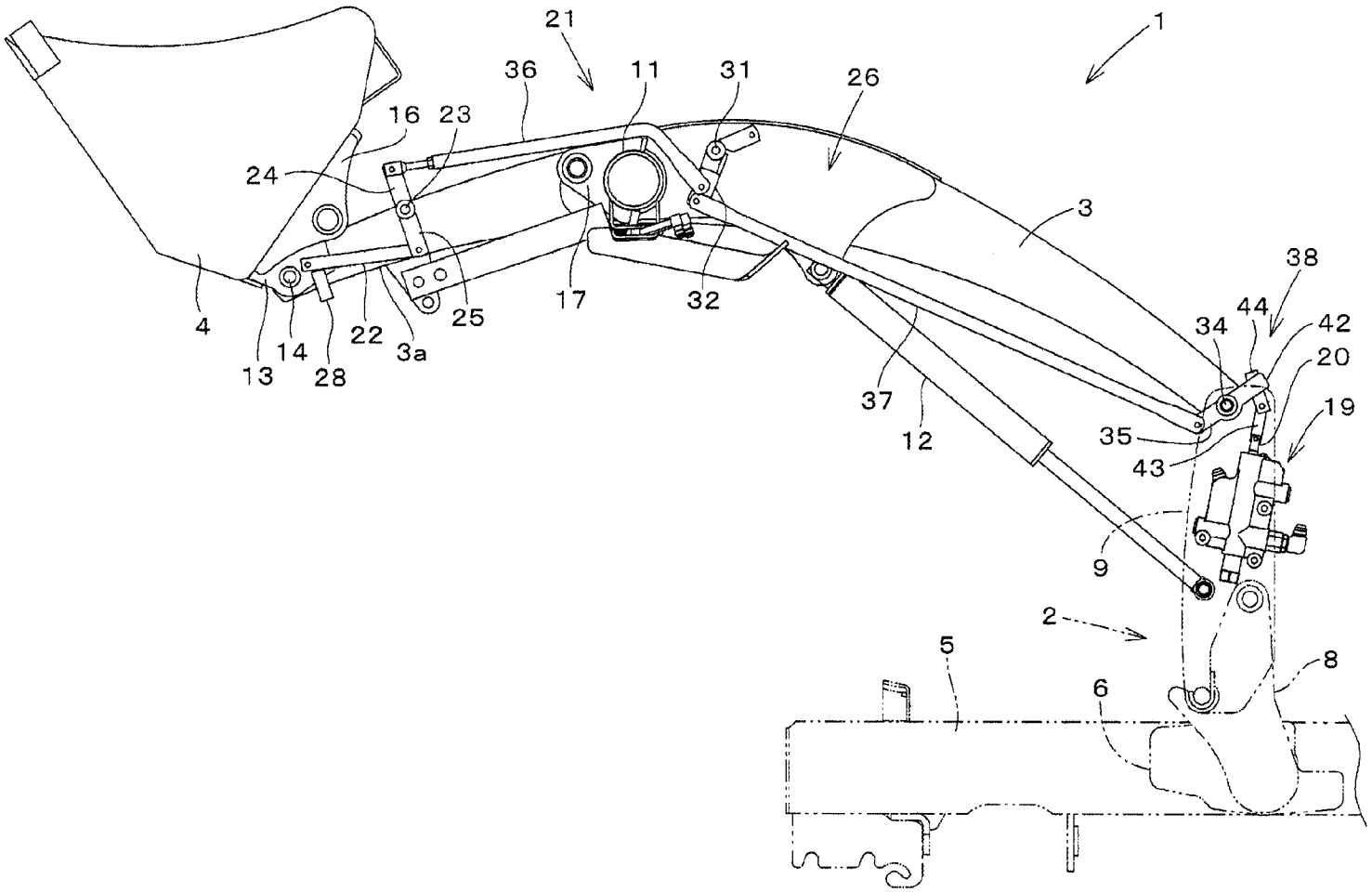
FIG. 1 is a side view of a front loader according to a first embodiment.
Figure 2:
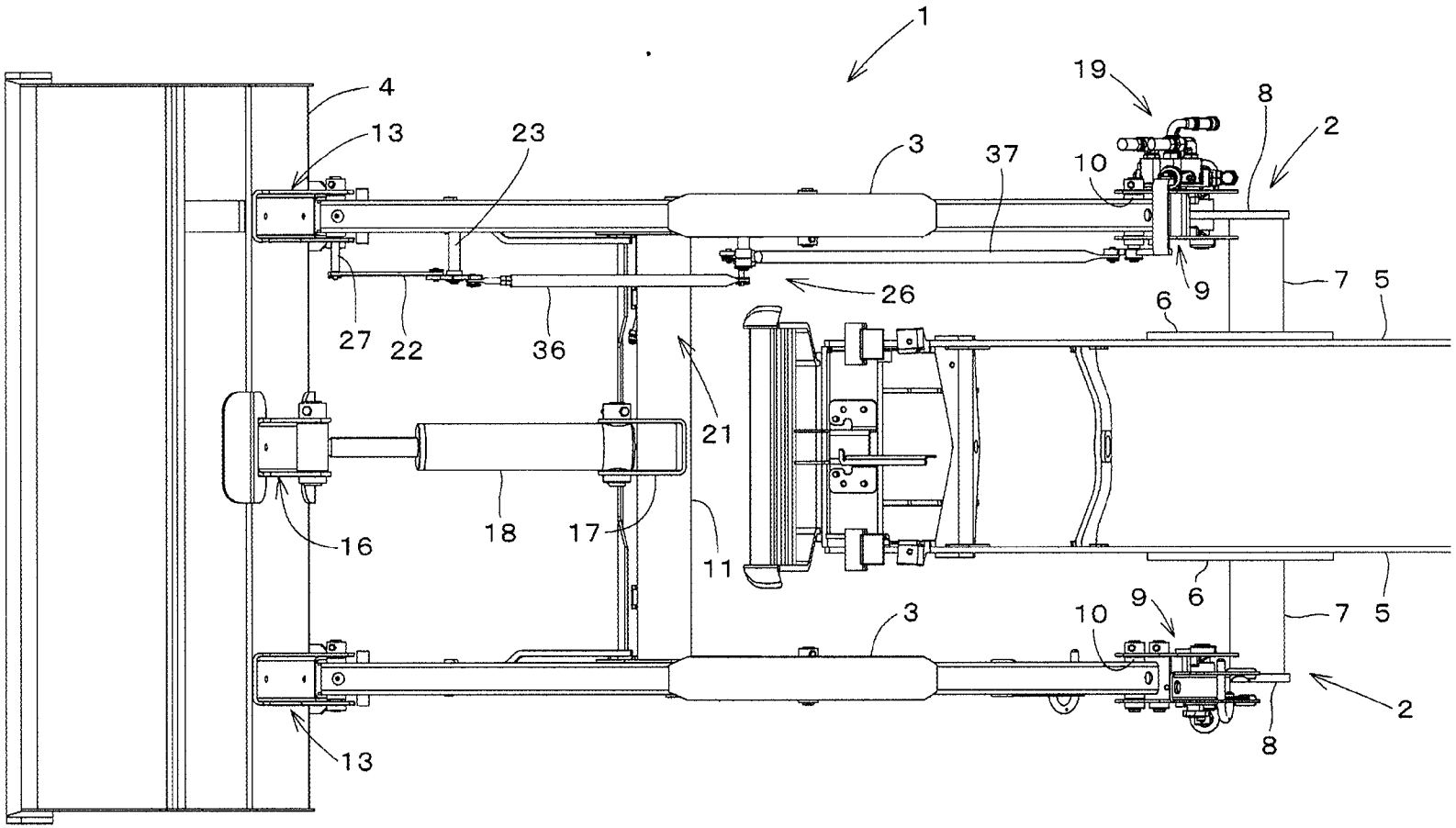
FIG. 2 is a plan view of the front loader according to the first embodiment.
Figure 3:
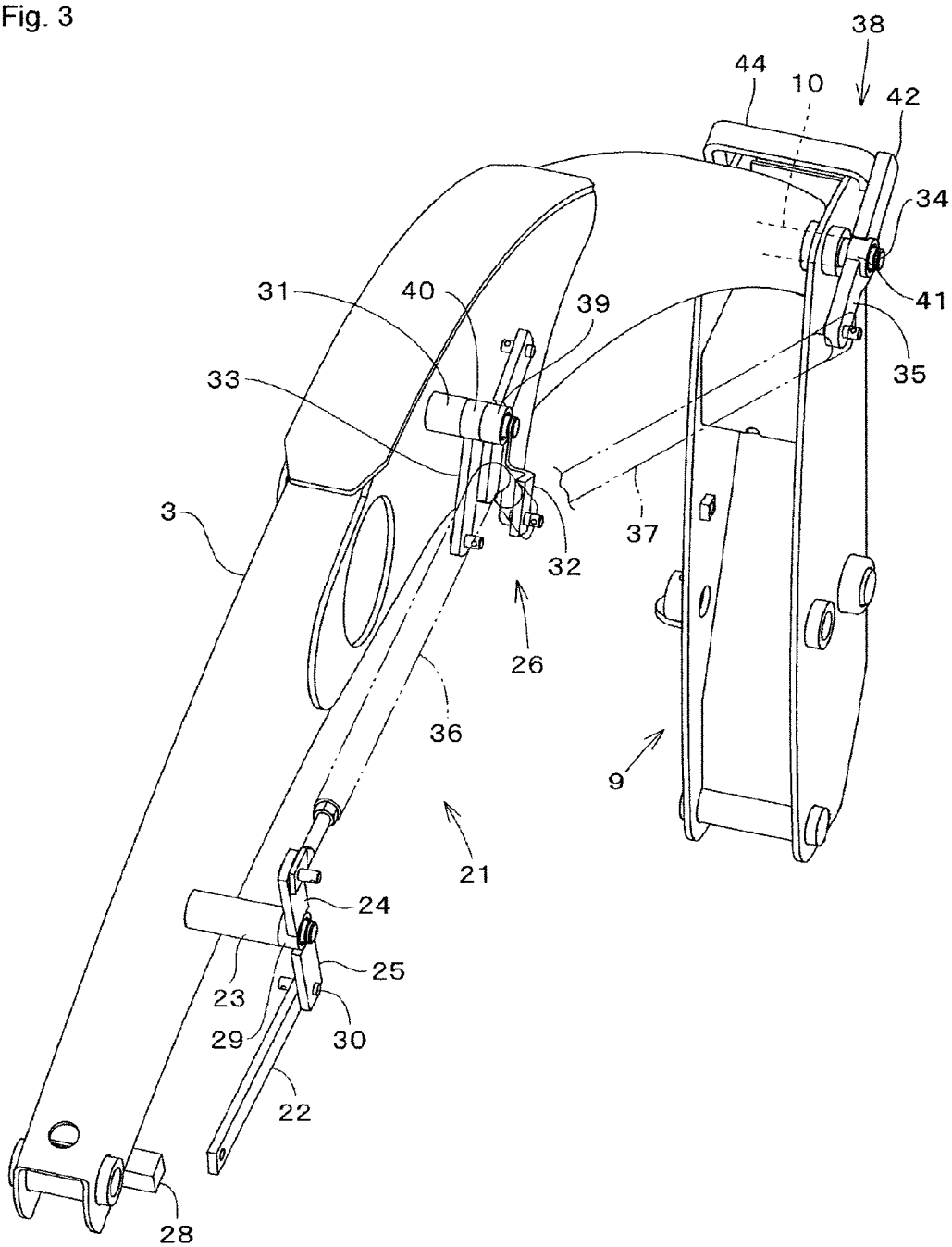
FIG. 3 is a perspective view of a main portion of the front loader according to the first embodiment.

In FIGS. 1 to 3, a front loader 1, which is mounted on a front portion of a tractor, has an attachment frame 2 to be attached to a tractor, a boom 3 supported swingably upward and downward by the attachment frame 2, and a bucket 4 attached to a distal end portion (front end portion) of the boom 3. A pair of the attachment frames 2 and a pair of the booms 3 are provided on the left and right. The attachment frames 2 and the booms 3 are disposed on the left and right sides of a hood of the tractor. The bucket 4 is disposed in front of the hood.

Each of the left and right attachment frames 2 has an attachment plate 6 attached and fixed to a side frame 5 mounted on a vehicle body of the tractor, a support base 7 projecting outward in the left-right direction from the attachment plate 6, a main frame 8 projecting upward and attached to an external end portion in the left-right direction of the support base 7, and a side frame (boom support) 9 projecting upward and attachably and detachably provided on the main frame 8.

A proximal end portion (rear end portion) of each of the left and right booms 3 is pivoted and connected to an upper portion of the side frame 9 on the same left-right direction side rotatable around the left-right direction axis center through a boom support axis 10 so as to be swingable upward and downward (lifting and lowering). The left and right booms 3 are mutually connected in longitudinal middle portions by a cylindrical boom connector 11.

A boom cylinder 12 being a double-acting hydraulic cylinder is provided from the longitudinal middle portion of the boom 3 to a vertical middle portion of the side frame 9. The left and right boom cylinders 12 expand and contract to allow the booms 3 to swing upward and downward (the boom cylinders 12 expand to allow the booms 3 to perform lifting and contract to allow the booms 3 to perform lowering).

The boom cylinders 12 are controlled by a boom control valve 57 (refer to FIG. 10) which is manually operated by an operation tool, such as an operation lever. The boom control valve 57 is provided in the tractor. A bucket bracket 13 is rotatably pivoted and connected to the distal end portion (front end portion) of each of the booms 3 around the axis center in the left-right direction through a bucket pivot support axis 14. Each of the left and right bucket brackets 13 is welded to a lower portion of a rear surface of the bucket (bucket main body) 4. Thus, the bucket 4 is supported swingably (capable of scooping and dumping) around the left-right axis on the front end portions of the booms 3.

In the first embodiment, it is considered that the bucket brackets 13 are included in the configuration of the bucket 4. Cylinder brackets 16 and 17 are fixed to a left-right central portion in the lower portion of the rear surface of the bucket 4 and to a left-right central portion of the boom connector 11, respectively. A bucket cylinder 18 being a double-acting hydraulic cylinder is provided between the cylinder brackets 16 and 17. The bucket cylinder 18 expands and contracts to allow the bucket 4 to swing upward and downward (the bucket cylinder 18 expands to allow the bucket 4 to perform dumping and contracts to allow the bucket 4 to perform scooping).

The bucket cylinder 18 is controlled by a bucket control valve 58 (refer to FIG. 10) which is manually operated by an operation tool, such as an operation lever. The bucket control valve 58 is provided in the tractor. A control valve 19 (referred to as an auto dumping control valve) is provided in an upper portion of an external side surface in the left-right direction on either the left or right (right in the present embodiment) side of the side frame 9, the control valve 19 allowing dumping of the bucket 4 in conjunction with lifting of the booms 3 so as to maintain the posture of the bucket 4 in a substantially constant state.

Figure 10:
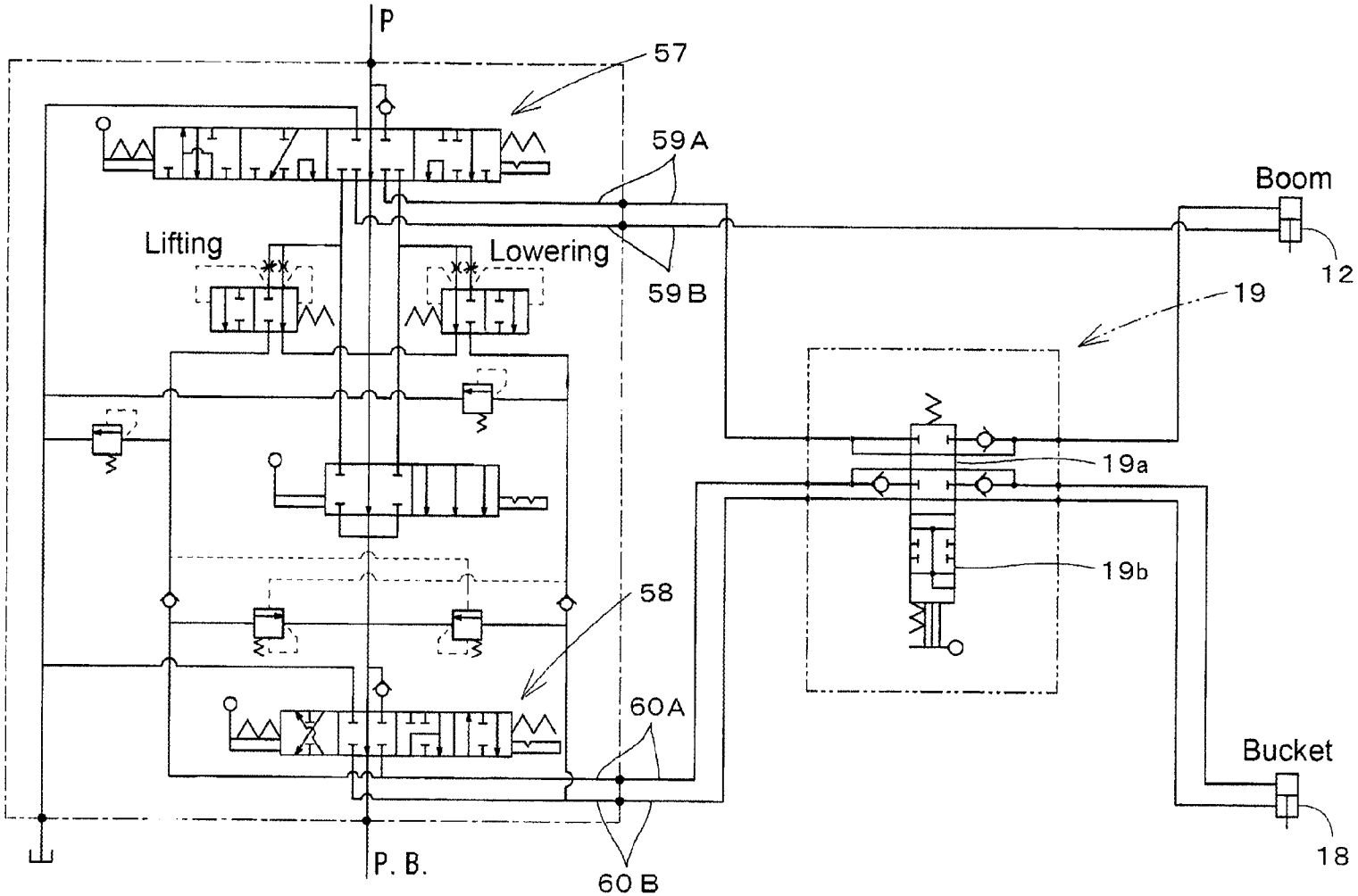
FIG. 10 is a hydraulic circuit diagram of a front loader.
Figure 11:
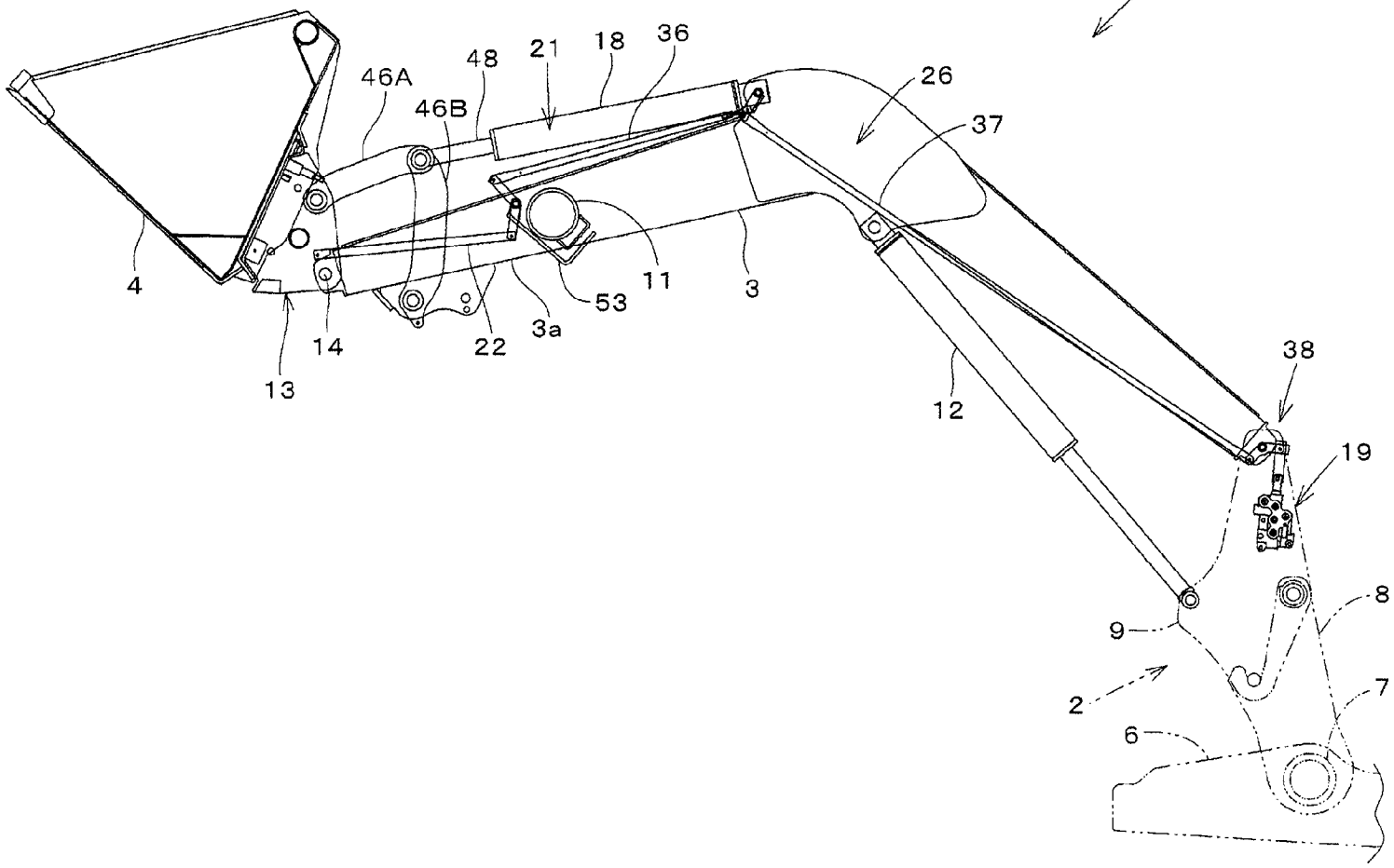
FIG. 11 is a side view of a front loader according to a second embodiment.
Figure 12:
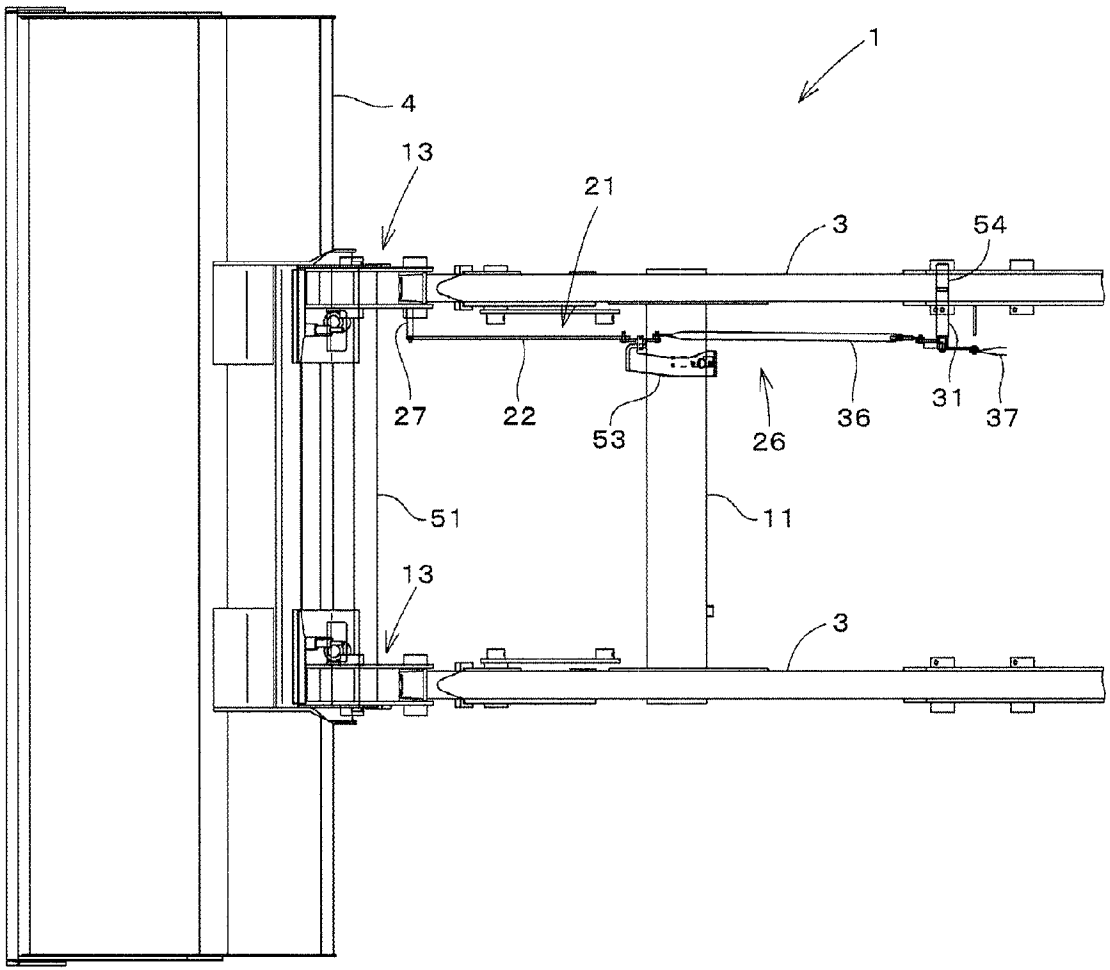
FIG. 12 is a plan view of the front loader according to the second embodiment.
Figure 13:
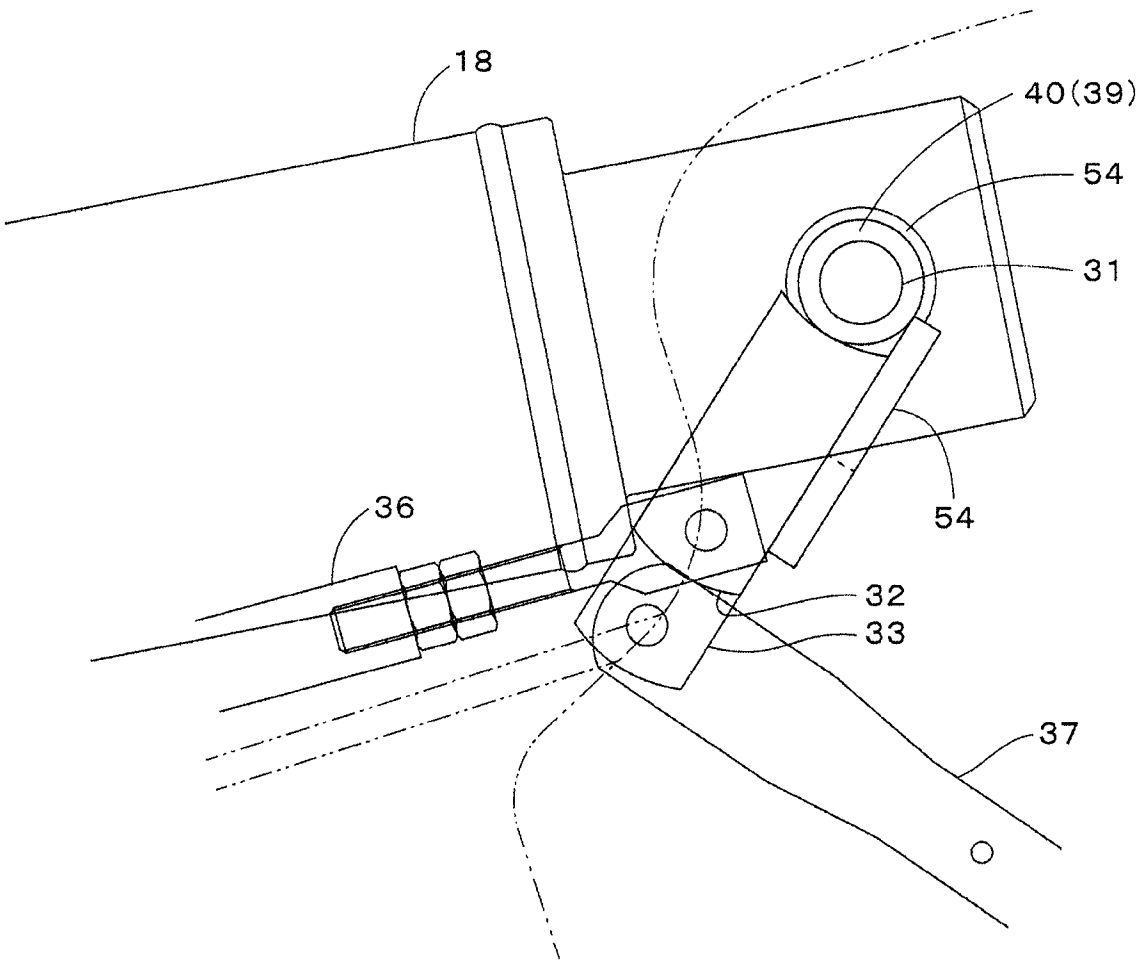
FIG. 13 is a side view of a front portion of a right boom of the front loader according to the second embodiment.
Figure 14:
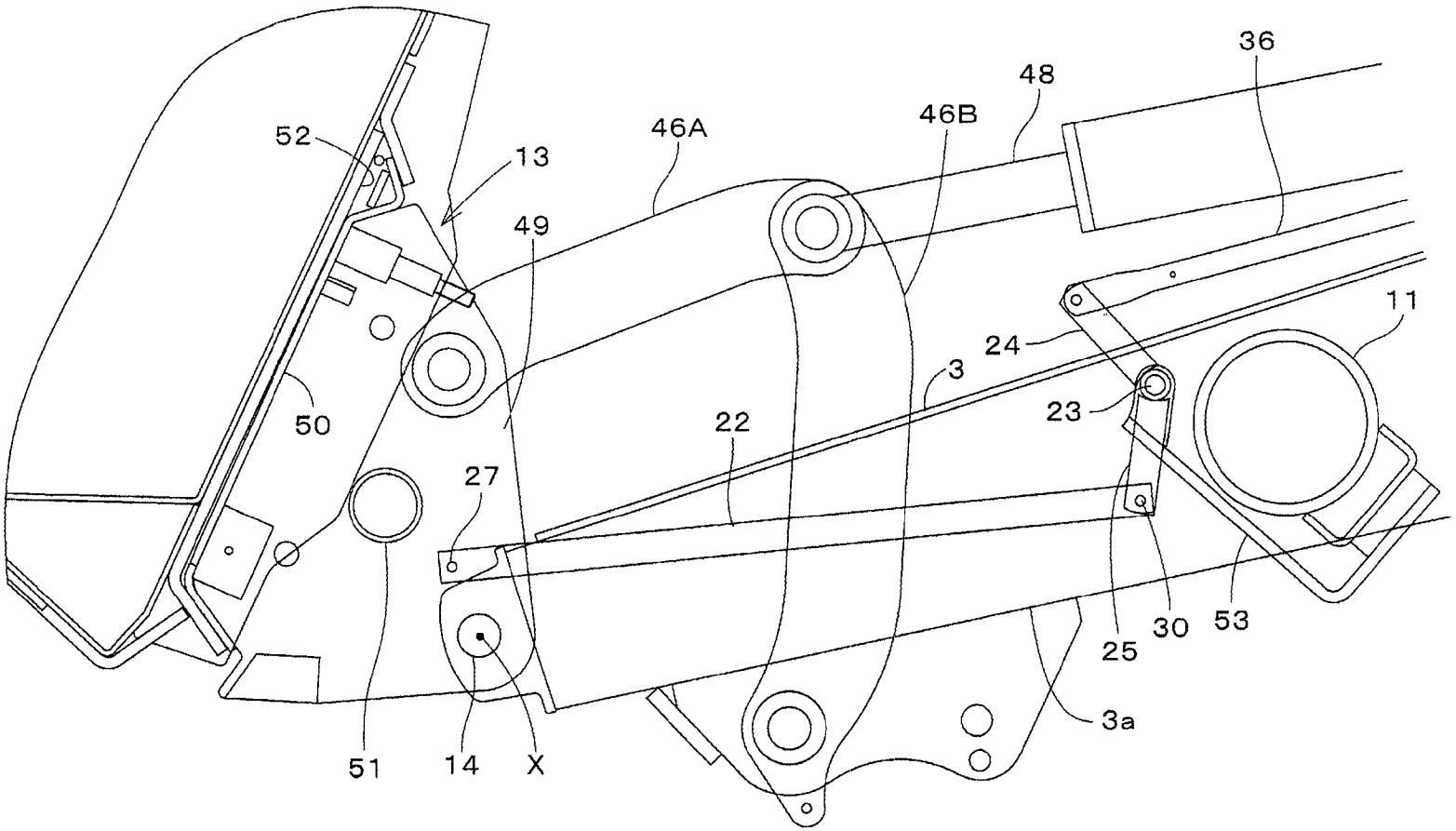
FIG. 14 is a side view of a middle portion of the right boom of the front loader according to the second embodiment.
Figure 15:
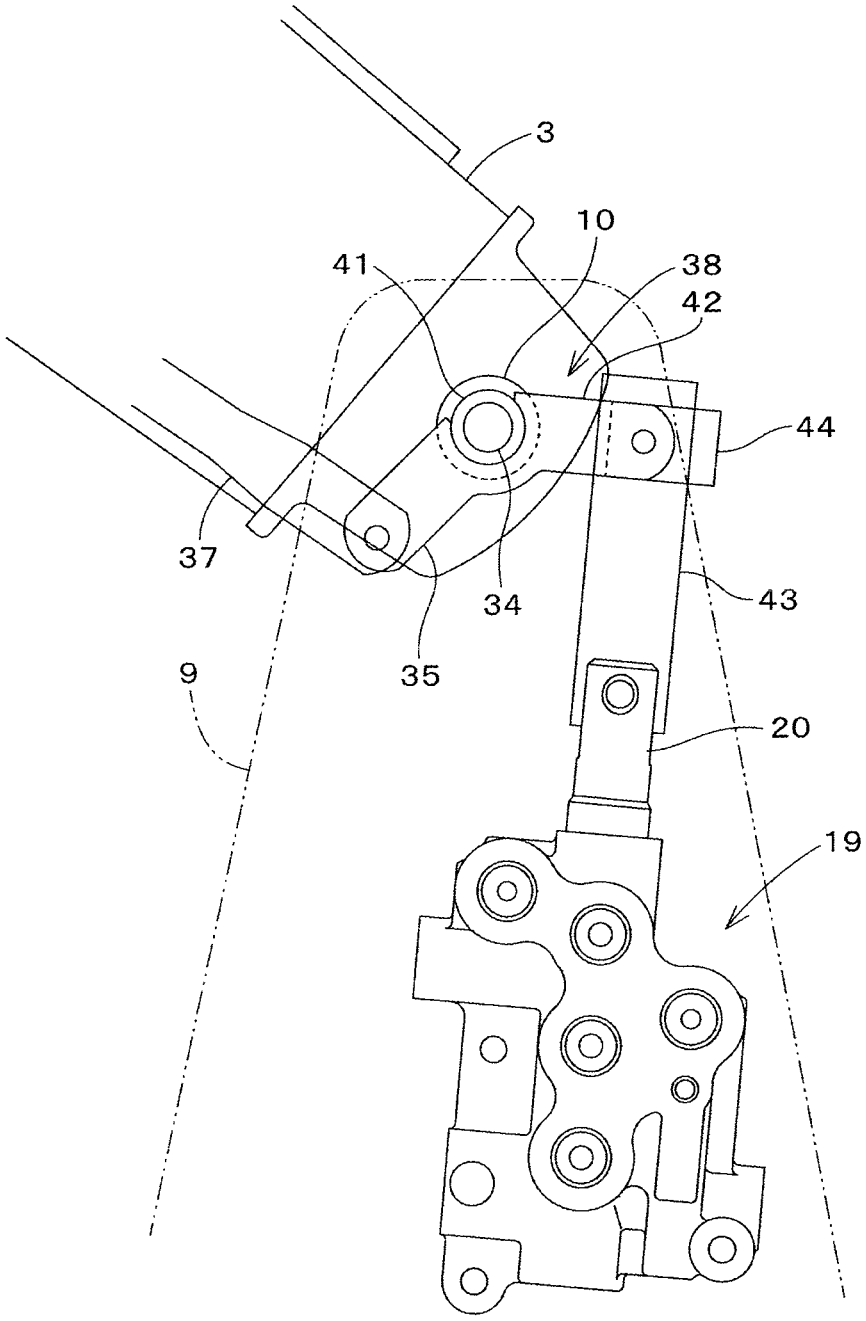
FIG. 15 is a side view of a rear portion of the right boom of the front loader according to the second embodiment.
Figure 16:
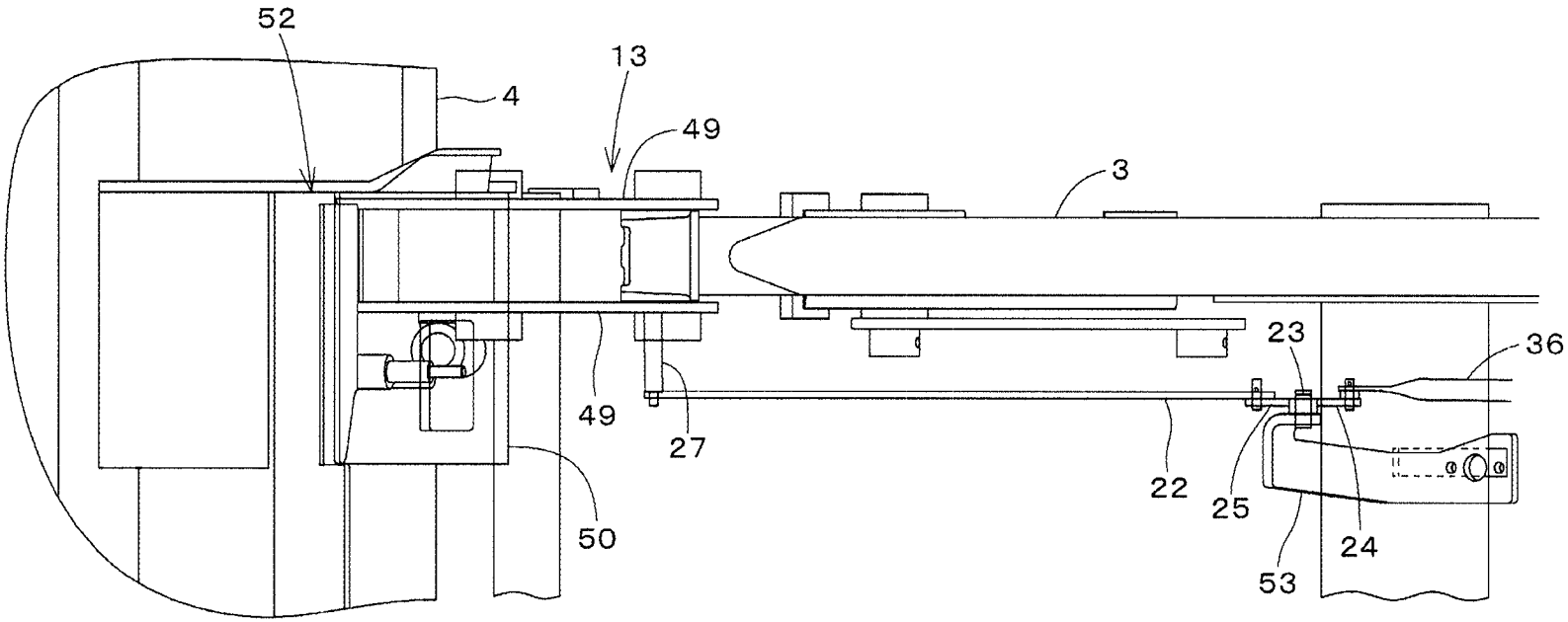
FIG. 16 is a plan view of the front portion of the right boom of the front loader according to the second embodiment.

In addition, the auto dumping control valve 19 stops scooping of the bucket 4 before the tilt angle of the bucket 4 relative to the horizontal plane reaches a "spill area" where scooped materials, such as soil and sand, spill out of the bucket 4 (alternatively, when the tilt angle reaches the "spill area") during scooping of the bucket 4. With reference to FIG. 10, the auto dumping control valve 19 is a direct-acting spool type two-position switching valve, which has a spool 20 projecting upward (refer to FIG. 6). Pressing the spool 20 downward switches the valve from a neutral position 19*a* to a control position 19*b*. A return spring returns the valve to the neutral position 19*a*.

Hydraulic oil pipelines 59A, 60A, and 60B pass through the auto dumping control valve 19, the hydraulic oil pipeline 59A being provided from the boom control valve 57 to the bottom (lifting) side of the boom cylinder 12, the hydraulic oil pipelines 60A and 60B being provided from the bucket control valve 58 to the bottom (dumping) side and to the rod (scooping) side, respectively, of the bucket cylinder 18. A hydraulic oil pipeline 59B does not pass through the auto dumping control valve 19, the hydraulic oil pipeline 59B being provided from the boom control valve 57 to the rod (lowering) side of the boom cylinder 12.

Either the left or right boom 3 (right in the present embodiment) is provided with a spill guard link mechanism 21 that interlocks and connects the bucket brackets 13 and the auto dumping control valve 19. In order to maintain the posture of the bucket 4 during lifting of the booms 3, the spill guard link mechanism 21 mainly controls the auto dumping control valve 19 to allow dumping of the bucket 4 in conjunction with lifting of the booms 3 and provides feedback of the dumping of the bucket 4 to the auto dumping control valve 19.

The spill guard link mechanism 21 has a detection link 22, a rotation arm 24, an interlock arm 25, and an interlock mechanism 26, the detection link 22 being disposed in the front end portion of the boom 3 to detect swinging (dumping and scooping) of the bucket 4, the rotation arm 24 being rotatably supported around the left-right axis in the front portion of the boom 3 through a rotation support axis 23, the interlock arm 25 being integrally rotated with the rotation arm 24, the interlock mechanism 26 interlocking and connecting the rotation arm 24 and the spool 20 of the auto dumping control valve 19.

Figure 4:
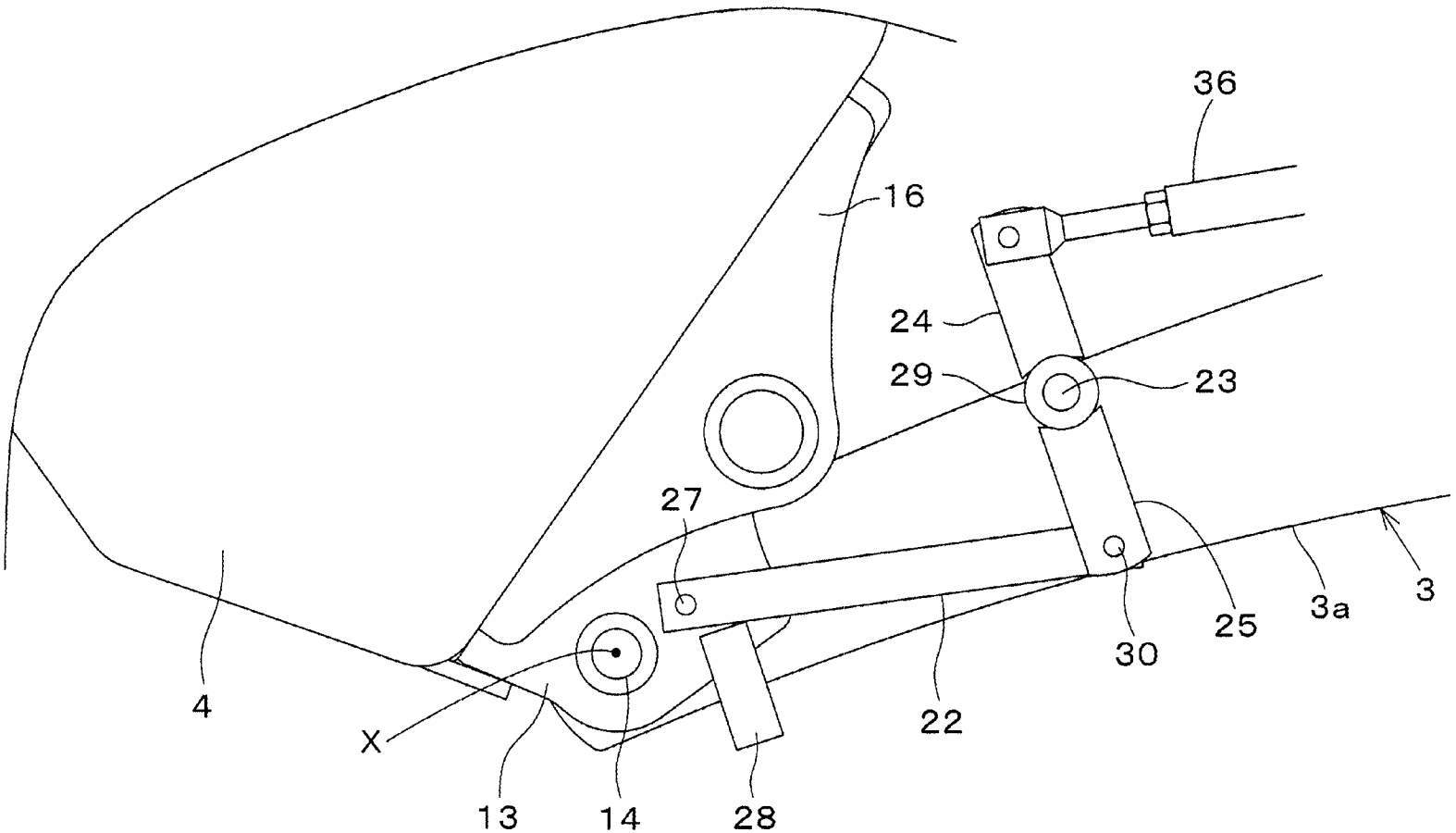
FIG. 4 is a side view of a front portion of a right boom of the front loader according to the first embodiment.
Figure 5:
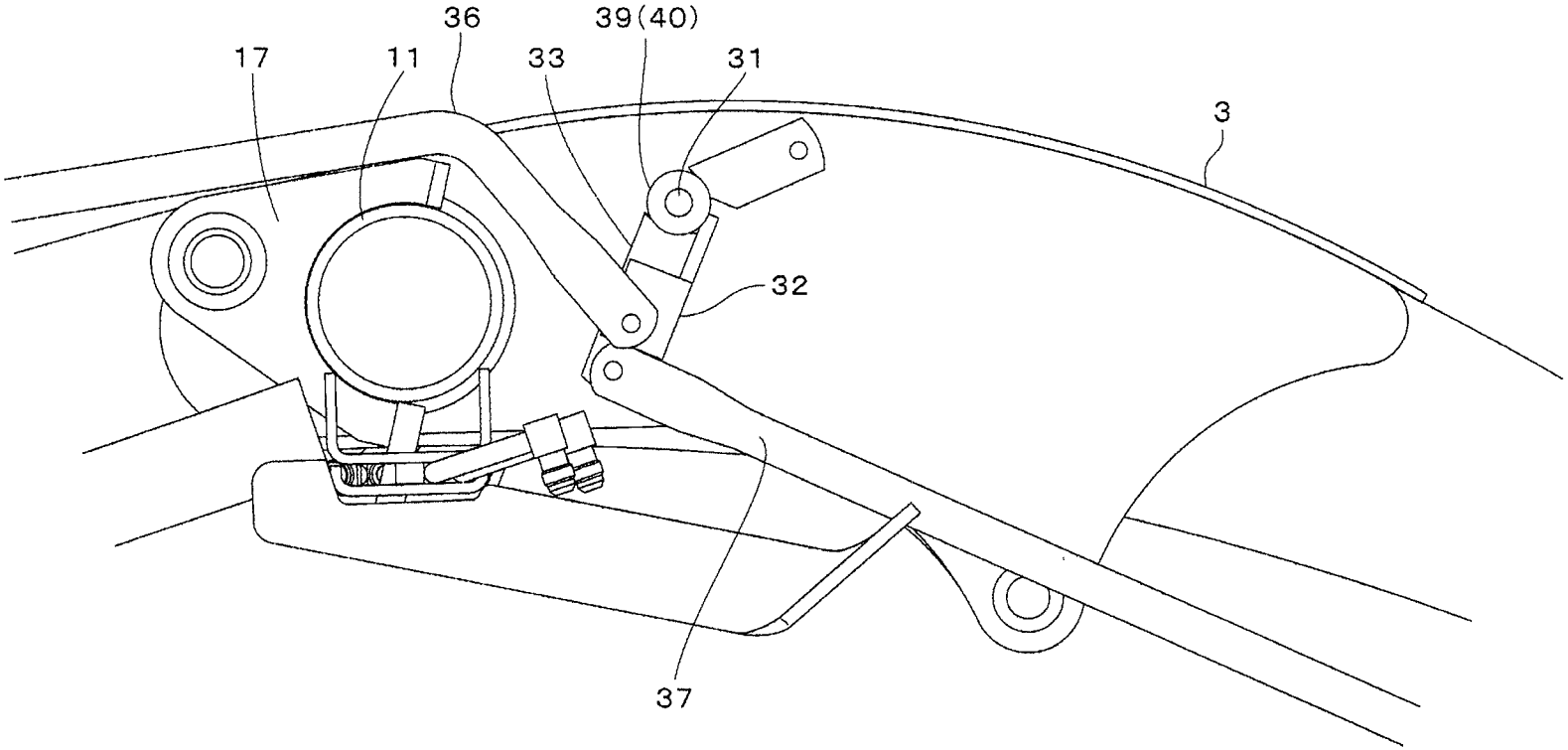
FIG. 5 is a side view of a middle portion of the right boom of the front loader according to the first embodiment.
Figure 6:
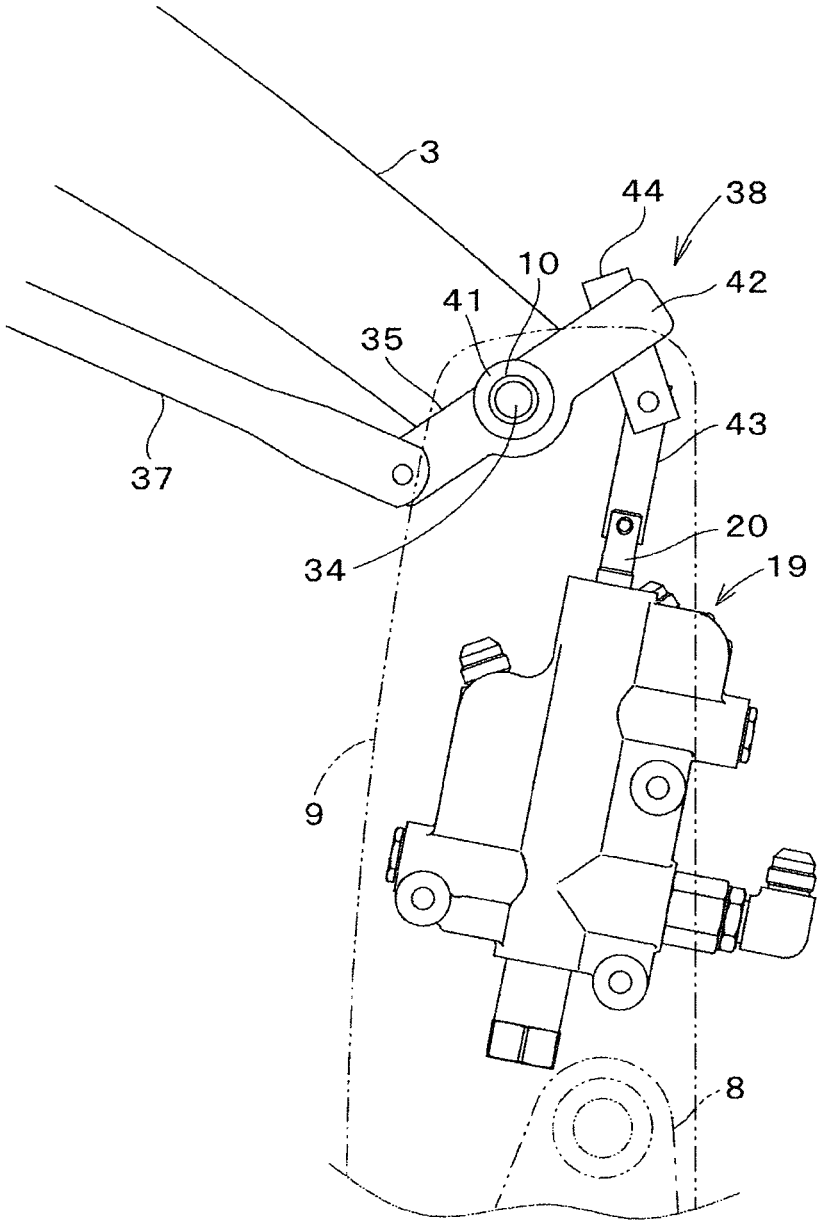
FIG. 6 is a side view of a rear portion of the right boom of the front loader according to the first embodiment.
Figure 7A:
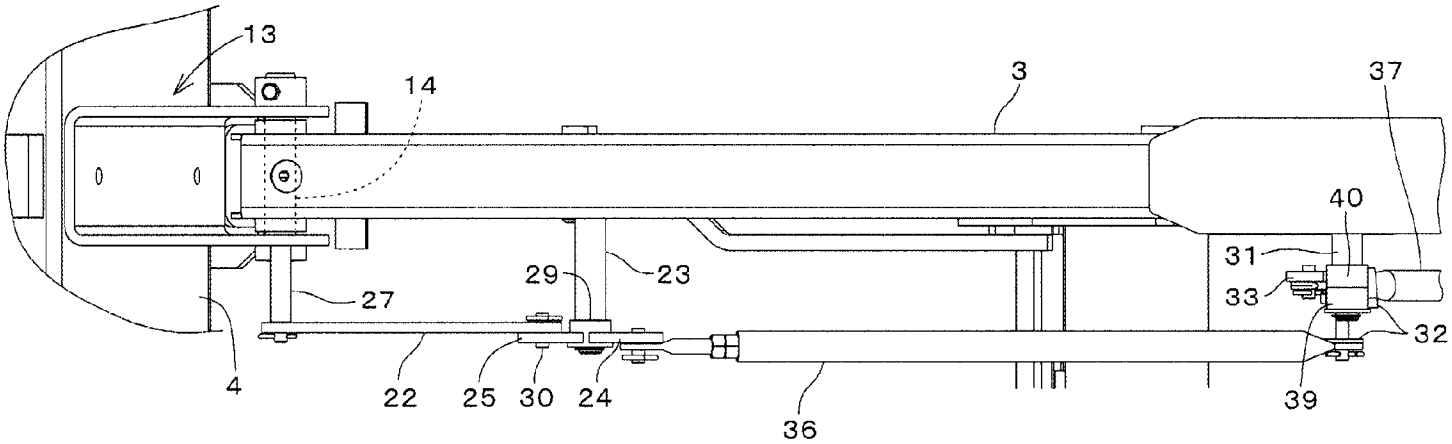
FIGS. 7A and 7B are each a plan view of the right boom of the front loader according to the first embodiment.
Figure 7B:
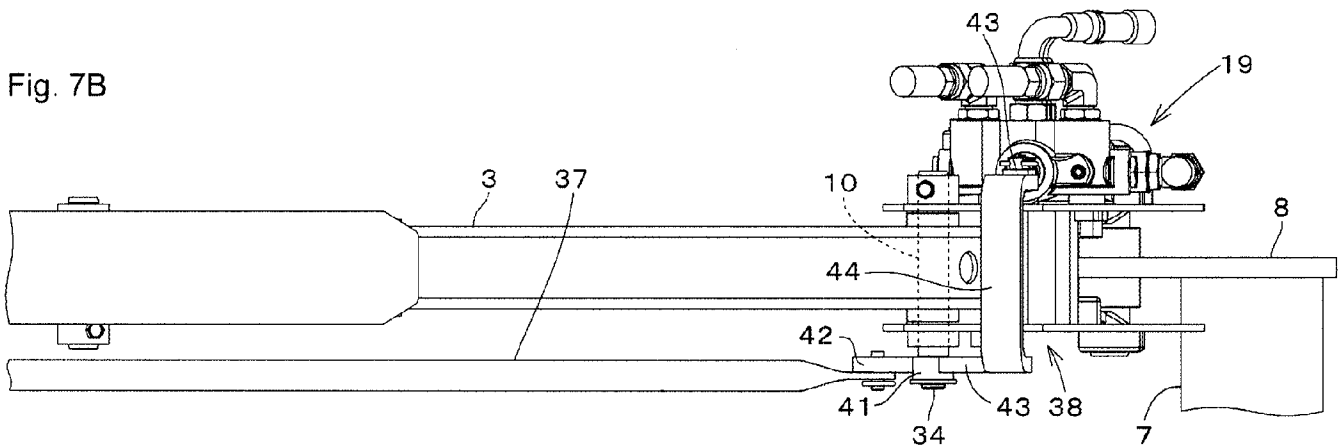
Figure 8:
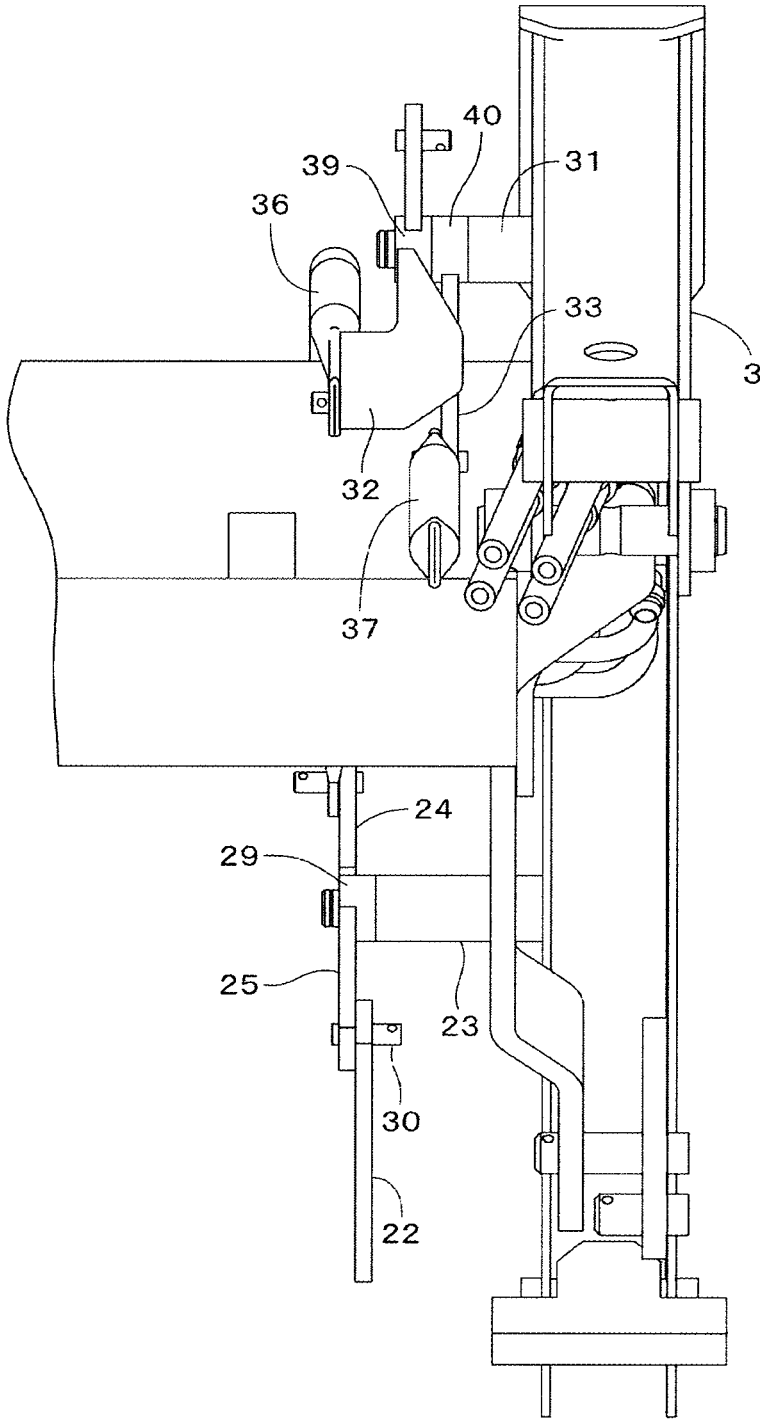
FIG. 8 is a rear view of the right boom of the front loader according to the first embodiment.
Figure 9:
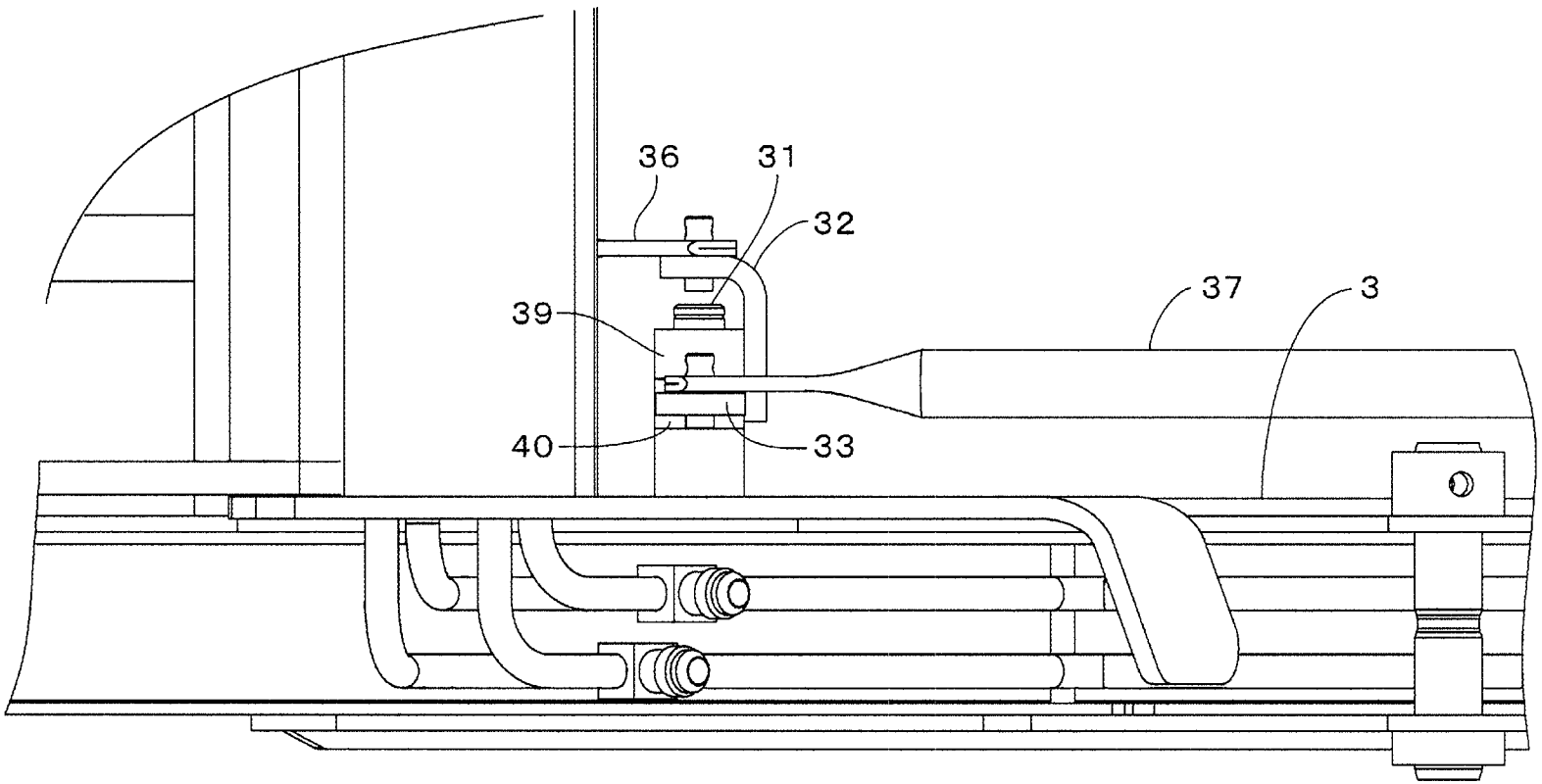
FIG. 9 is a bottom view of the middle portion of the right boom of the front loader according to the first embodiment.

As shown in FIGS. 4 and 7A, the detection link 22 is disposed on the interior in the left-right direction (left side) of the right boom 3 along the longitudinal direction of the boom 3 substantially within the vertical width of the boom 3. The front end portion of the detection link 22 is rotatably pivoted and connected around the axis center in the left-right direction to a link support axis 27 projecting from the right bucket bracket 13 toward the interior in the left-right direction (central portion between the left and right booms 3).

The link support axis 27 is disposed proximate to the bucket pivot support axis 14 and is positioned above the axis center X of the bucket pivot support axis 14. Thus, the front end portion of the detection link 22 is pivoted and connected to the bucket bracket 13 in the vicinity of the bucket pivot support axis 14 and above a lower surface 3*a* of the boom 3. A pivot support portion (portion pivoted and supported by the link support axis 27) in the front end portion of the detection link 22 is positioned above the axis center X of the bucket pivot support axis 14.

The front portion of the detection link 22 is positioned above a rotation regulating member 28 that regulates rotation of the dumping side of the bucket 4. As shown in FIGS. 4 and 7A, the rotation arm 24 is disposed on the interior in the left-right direction of the right boom 3. A base end portion of the rotation aim 24 is fixed to a boss 29 externally fitted and supported rotatably around the axis center in the left-right direction to the rotation support axis 23 which projects inward in the left-right direction from the front portion of the right boom 3. The rotation arm 24 projects from the boss 29 toward an upper surface of the boom 3.

The interlock arm 25 is disposed on the interior in the left-right direction of the right boom 3. A base end portion of the interlock arm 25 is fixed to the boss 29 supported by the rotation support axis 23. The interlock aim 25 projects from the boss 29 toward the lower surface 3*a* of the boom 3. The rotation aim 24 and the interlock arm 25 are integrally rotatable through the boss 29.

The rear end portion of the detection link 22 is pivoted and connected to the front end portion of the interlock arm 25 through a pin 30. A pivot support portion (portion pivoted and supported by the pin 30) in the rear end portion of the detection link 22 is positioned above the lower surface 3*a* of the boom 3. As shown in FIGS. 4 to 9, the interlock mechanism 26 has a first relay arm 32, a second relay arm 33, a swing arm 35, a first interlock link 36, a second interlock link 37, and a spool operation member 38, the first relay arm 32 being rotatably supported around the axis center in the left-right direction in the longitudinal middle portion of the boom 3 through a relay axis 31, the second relay arm 33 being rotatably supported around the axis center in the left-right direction in the middle portion of the boom 3 through the relay axis 31, the swing arm 35 being rotatably supported around the axis center in the left-right direction in the proximal end portion of the boom 3 through a swing support axis 34, the first interlock link 36 being provided from the rotation arm 24 to the first relay arm 32, the second interlock link 37 being provided from the second relay arm 33 to the swing arm 35, the spool operation member 38 being rotated integrally with the swing arm 35 and being interlocked and connected to the spool 20 of the auto dumping control valve 19.

The relay axis 31 projects inward in the left-right direction from the right side surface of the right boom 3. The first relay arm 32 is disposed in the interior in the left-right direction of the right boom 3 and is provided in a base end portion with a boss 39 externally fitted to and rotatably supported by the relay axis 31 around the axis center. The first relay arm 32 projects from the boss 39 toward the lower surface 3*a* of the boom 3. The second relay arm 33 is disposed in the interior in the left-right direction of the right boom 3 and is provided in a base end portion with a boss 40 externally fitted to and rotatably supported by the relay axis 31 around the axis center. The second relay arm 33 projects from the boss 40 toward the lower surface 3*a* of the boom 3.

The first relay arm 32 is engaged with the second relay arm 33 so as to rotate integrally therewith during scooping of the bucket 4. The swing support axis 34 projects inward in the left-right direction from the boom support axis 10 that pivots and supports the proximal portion of the right boom 3. The swing arm 35 is disposed in the interior in the left-right direction of the right boom 3 and is fixed at a base end portion to a boss 41 externally fitted on the swing support axis 34 and rotatably supported around the axis center in the left-right direction.

The first interlock link 36 and the second interlock link 37 are disposed in the interior in the left-right direction of the right boom 3. A distal end portion, which is a first end portion in the longitudinal direction, of the first interlock link 36 is pivoted and connected to the front end portion of the rotation arm 24; a proximal end portion, which is a second end portion in the longitudinal direction, of the first interlock link 36 is pivoted and connected to the front end portion of the first relay arm 32.

A distal end portion, which is a first end portion in the longitudinal direction, of the second interlock link 37 is pivoted and connected to the front end portion of the second relay aim 33; a proximal end portion, which is a second end portion in the longitudinal direction, of the second interlock link 37 is pivoted and connected to the front end portion of the swing ami 35. The spool operation member 38 has a base arm 42, an actuating link 43, and a connecting member 44, the base arm 42 being integrally provided with the swing arm 35, being fixed by the boss 41, and being rotated integrally with the swing arm 35, the actuating link 43 being disposed above the auto dumping control valve 19 and having a lower end portion pivoted and connected to the spool 20 of the auto dumping control valve 19, the connecting member 44 connecting the upper end portion of the actuating link 43 and the front end portion of the base arm 42.

The connecting member 44 has a downward U shape straddling the proximal portion of the boom 3 and the upper portion of the side frame 9. The left end portion is fixed to the front end portion of the base arm 42 and the right end portion is pivoted and connected to the upper end portion of the actuating link 43. In the front loader 1 having the configuration above, the booms 3 are lifted in a state where the bucket 4 filled with soil is lifted, and then the second interlock link 37 is lifted to rotate the swing arm 35 upward. Then, the base arm 42 of the spool operation member 38 is rotated downward to press down the actuating link 43 through the connecting member 44. Thereby, the spool 20 of the auto dumping control valve 19 is pressed in.

Pressing in the spool 20 of the auto dumping control valve 19 switches the auto dumping control valve 19 from the neutral position 19*a* to the control position 19*b*. In the control position 19*b*, a portion of actuation oil supplied to the bottom (lifting) side of the boom cylinder 12 is supplied to the bottom (dumping) side and the rod (scooping) side of the bucket cylinder 18. Due to an area difference between the bottom side and the rod side of the piston of the bucket cylinder 18, the bucket cylinder 18 expands and allows the bucket 4 to perform dumping.

As described above, the bucket 4 performs dumping in conjunction with lifting of the booms 3. Thus, the bucket 4 is maintained in the lifted position to prevent soil from spilling out of the bucket 4. Meanwhile, stopping lifting of the booms 3 stops dumping of the bucket 4 in the lifted position. Specifically, with dumping of the bucket 4, the detection link 22 is pulled and moved forward, and thus the interlock arm 25 is rotated forward and the rotation arm 24 is rotated backward. With the rotation arm 24 rotated backward, the first interlock link 36 is pressed and moved backward, and thus the first relay arm 32 is rotated backward and is disengaged from the second relay arm 33. Then, the second relay arm 33 is rotatable backward, releasing a force to press in the spool 20. An urging force of a return spring presses up the spool 20, thus rotating the base arm 42 upward through the actuating link 43 and the connecting member 44. With the base arm 42 rotated upward, the swing arm 35 is rotated downward and the second interlock link 37 is pulled and moved backward.

The spool 20 of the auto dumping control valve 19 is pressed up and returns to the neutral position 19*a*. Then, the actuation oil is stopped from being supplied to the bucket cylinder 18, thus stopping dumping of the bucket 4. Meanwhile, the bucket 4 performs scooping, and then the detection link 22 is pressed backward and the interlock arm 25 is rotated backward. Concurrently, the rotation arm 24 is rotated forward. With the rotation aim 24 rotated forward, the first interlock link 36 is pulled and moved forward, and thus the first relay arm 32 is rotated forward. The first relay arm 32 then rotates the second relay arm 33 forward. With the second relay arm 33 rotated forward, the second interlock link 37 is pulled and moved forward, and thus the swing arm 35 is rotated upward. Concurrently, the base arm 42 of the spool operation member 38 is rotated downward. Then, the actuating link 43 is pressed down through the connecting member 44, and thus the spool 20 of the auto dumping control valve 19 is pressed in and operated in the direction to switch from the neutral position 19*a* to the control position 19*b*.

The bucket 4 is rotated for a predetermined angle in the scooping direction. Then, the auto dumping control valve 19 is completely switched to the control position 19*b* before the tilt angle of the bucket 4 relative to the horizontal plane reaches the "spill area" where scooped materials, such as soil and sand, spill out of the bucket 4 (alternatively, when the tilt angle reaches the "spill area"). With the auto dumping control valve 19 completely switched to the control position 19*b*, the actuation oil is blocked from flowing, thus stopping scooping of the bucket 4, the actuation oil being supplied from the bucket control valve 58 to the rod (scooping) side of the bucket cylinder 18 through the hydraulic oil pipeline 60B.

At this time, the bucket control valve 58 enables dumping of the bucket 4. In the front loader 1 having no bucket link as in the first embodiment, the rotation angle of the bucket 4 is smaller than that of the front loader 1 having a bucket link, and thus the movement of the detection link 22 is small. However, the interlock arm 25 is rotated integrally with the rotation arm 24 and the rear end portion of the detection link 22 is pivoted and connected to the interlock arm 25. Thus, changing the length ratio of the rotation arm 24 and the interlock arm 25 allows easy setting of a movement amount of the first interlock link 36 in conjunction with the movement of the detection link 22.

Furthermore, the interlock arm 25 allows the pivot support portion in the front end portion of the detection link 22 to be disposed above the axis center X of the bucket pivot support axis 14, thus preventing the pivot support portion in the front end portion of the detection link 22 from coming into contact with the ground. In the front loader 1 according to the second embodiment as shown in FIGS. 11 to 17B, the present invention is applied to the front loader 1 having bucket links 46A and 46B, as described above.

The bucket links 46A and 46B include the first bucket link 46A having a first end portion pivoted and connected above the bucket pivot support axis 14 of the bucket bracket 13 and the second bucket link 46B having a first end portion pivoted and connected to a pivot support bracket 47 which is fixed to the lower surface 3*a* of the boom 3 and projects downward therefrom. Second end portions of the first bucket link 46A and the second bucket link 46B are pivoted and connected to the front end portion of the piston rod 48 of the bucket cylinder 18.

The front loader 1 according to the second embodiment is illustrated as an example in which the bucket 4 is attachable to and detachable from the bucket bracket 13. Accordingly, in the second embodiment, the bucket bracket 13 is illustrated separately from the bucket 4. The bucket bracket 13 has a pair of left and right plates 49 and engagement plates 50 fixed to front end portions of the left and right plates 49. The left and right bucket brackets 13 are connected by a connecting member 51.

In the lower portion of the rear surface of the bucket 4, a fitting portion 52 and a lock mechanism (not shown in the drawing) are provided, the fitting portion 52 being fitted by the engagement plate 50 of the bucket bracket 13, the lock mechanism preventing the bucket 4 from disengaging from the bucket bracket 13. As shown in FIGS. 13 to 17B, the rotation support axis 23 is provided in the support bracket 53 attached and fixed to the boom connector 11.

Figure 17A:
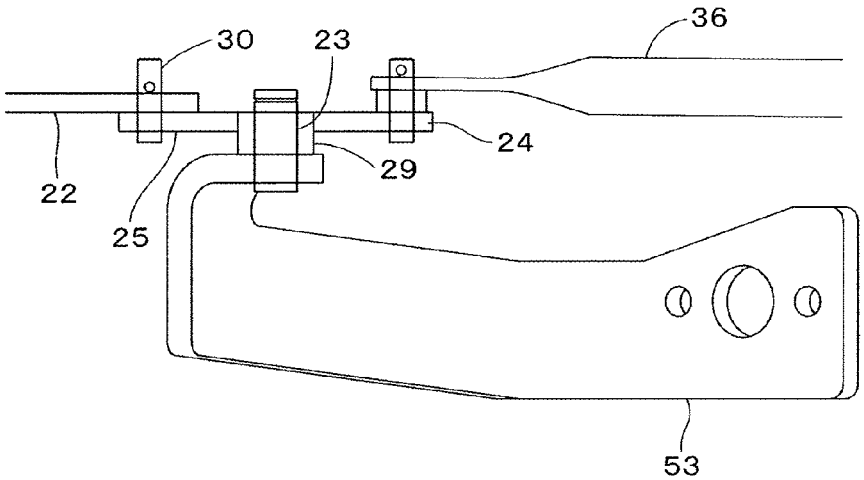
FIGS. 17A and 17B are each a partial plan view of a spill guard link mechanism of the front loader according to the second embodiment.
Figure 17B:
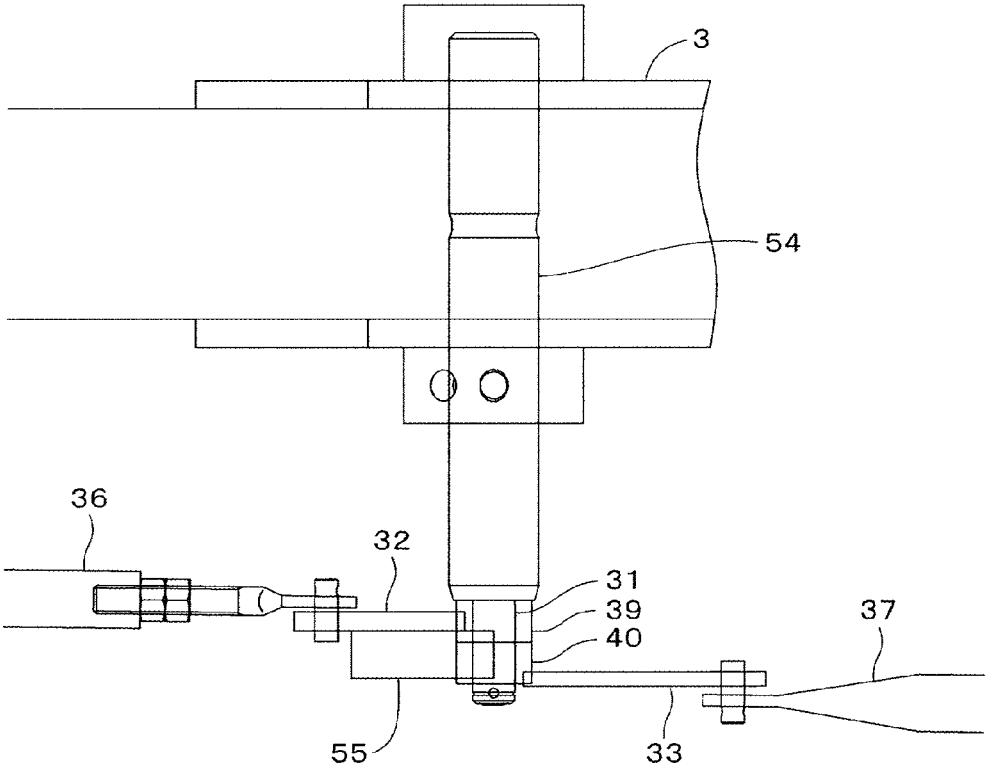

As shown in FIG. 17B, the relay axis 31 is integrally provided with the cylinder support axis 54 that pivots and supports the bottom portion of the bucket cylinder 18. The first relay arm 32 is provided with an engagement plate 55 that engages with the second relay arm 33 so as to rotate integrally with the second relay arm 33 during scooping of the bucket 4. Other configurations are the same as those in the first embodiment. Components and mechanisms having similar functions are denoted with the same reference numerals and their descriptions are omitted.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above described embodiments, and various variations and modifications may be possible without departing from the scope of the present invention.

What is claimed is:

1. A front loader having a spill guard link mechanism, the front loader comprising:

a boom lifted and lowered by a boom cylinder;

a bucket bracket pivoted and supported at a front end portion of the boom through a bucket pivot support axis;

a bucket fixed by the bucket bracket and performing scooping and dumping in association with the bucket bracket rotated around the bucket pivot support axis by a bucket cylinder;

a control valve allowing the bucket to perform dumping during lifting of the boom; and a spill guard link mechanism controlling the control valve to allow the bucket to perform dumping in conjunction with lifting of the boom so as to maintain a posture of the bucket, the spill guard link mechanism comprising a detection link disposed at the front end portion of the boom to detect dumping of the bucket during lifting of the boom, wherein the detection link has a front end portion pivoted and connected to the bucket bracket at a position proximate to the bucket pivot support axis, above a lower surface of the boom, and above the axis center of the bucket pivot support axis, the detection link has a rear end portion pivoted and connected to an interlock arm rotatably supported around a rotation support axis provided in an upper front portion of the boom, the spill guard link mechanism comprises:

a first interlock link having a front end portion pivoted and connected to a rotation arm rotated integrally with the interlock arm and a rear end portion pivoted and connected to a first relay arm rotatably supported by a relay axis provided at a middle portion of a side surface of the boom; and a second interlock link having a front end portion pivoted and connected to a second relay arm rotatably pivoted and supported by the relay axis and a rear end portion pivoted and connected to an operation arm of the control valve, and the spill guard link mechanism is provided on a side surface of the boom of the front loader to transfer an operation of the detection link to the control valve through an interlock mechanism comprising the first interlock link and the second interlock link.

2. The front loader according to claim 1, wherein the boom of the front loader has a pair of left and right booms mutually connected by a boom connector, and one of a pair of the booms is provided with the spill guard link mechanism at an internal surface thereof.

3. The front loader according to claim 1, wherein the detection link of the spill guard link mechanism is positioned above the lower surface of the boom and within a width of the side surface of the boom, the first interlock link has the front end portion pivoted and connected to the rotation arm rotated integrally with the interlock arm that pivots and connects the detection link in the front portion of the boom, and the rear end portion pivoted and connected to the first relay arm rotatably supported by the relay axis provided at the middle portion of the side surface of the boom straddling behind and above a boom connecting member, and the second interlock link has the front end portion pivoted and connected to the second relay arm rotatably pivoted and supported by the relay axis and the rear end portion pivoted and connected to the operation arm of the control valve, and the second interlock link is positioned below the side surface of the boom.

4. A front loader having a spill guard link mechanism, the front loader comprising:

a boom lifted and lowered by a boom cylinder;

a bucket bracket pivoted and supported at a front end portion of the boom through a pivot support axis;

a bucket fixed by the bucket bracket and performing scooping and dumping in association with the bucket bracket rotated around the bucket pivot support axis by a bucket cylinder;

a control valve allowing the bucket to perform dumping during lifting of the boom; and a spill guard link mechanism controlling the control valve to allow the bucket to perform dumping in conjunction with lifting of the boom so as to maintain a posture of the bucket, the spill guard link mechanism comprising a detection link disposed at the front end portion of the boom to detect dumping of the bucket during lifting of the boom, the spill guard link mechanism transmitting an operation of the detection link to the control valve through an interlock mechanism comprising a first interlock link and a second interlock link, wherein the detection link is positioned above a lower surface of the boom and within a width of a side surface of the boom, the first interlock link transmitting the operation of the detection link has a front end portion pivoted and connected to a rotation arm transmitting the operation of the detection link at the front portion of the boom, and a rear end portion pivoted and connected to a first relay arm rotatably supported by a relay axis provided at a middle portion of a side surface of the boom straddling behind and above a boom connecting member, and the second interlock link actuating the control valve in conjunction with the first interlock link has a front end portion pivoted and connected to a second relay arm pivoted and supported by the relay axis and a rear end portion pivoted and connected to an operation arm of the control valve.

* * * * *